US006814141B2

(12) United States Patent
Huh et al.

(10) Patent No.: US 6,814,141 B2
(45) Date of Patent: Nov. 9, 2004

(54) METHOD FOR IMPROVING OIL RECOVERY BY DELIVERING VIBRATIONAL ENERGY IN A WELL FRACTURE

(75) Inventors: Chun Huh, Houston, TX (US); Philip Lee Wylie, Jr., Houston, TX (US); Jung-gi Jane Shyeh, Houston, TX (US); Jeffrey R. Bailey, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 10/141,750

(22) Filed: May 9, 2002

(65) Prior Publication Data

US 2003/0042018 A1 Mar. 6, 2003

Related U.S. Application Data

(60) Provisional application No. 60/295,277, filed on Jun. 1, 2001.

(51) Int. Cl.[7] ..... E21B 43/25; E21B 28/00

(52) U.S. Cl. ..... 166/249; 166/177.1; 166/50; 166/308

(58) Field of Search ..... 166/249, 250.1, 166/308, 286, 369, 50, 177.1, 272.7, 272.3; 299/2

(56) References Cited

U.S. PATENT DOCUMENTS

| | | | | | |
|---|---|---|---|---|---|
| 2,670,801 | A | | 3/1954 | Sherborne | 166/21 |
| 3,002,454 | A | | 10/1961 | Chesnut | 102/21 |
| 3,220,476 | A | * | 11/1965 | Brandon | 166/249 |
| 3,692,110 | A | * | 9/1972 | Grady | 166/245 |
| 3,754,598 | A | | 8/1973 | Holloway, Jr. | 166/249 |
| 3,990,512 | A | * | 11/1976 | Kuris | 166/249 |
| 4,109,721 | A | * | 8/1978 | Slusser | 166/280 |
| 4,280,558 | A | * | 7/1981 | Bodine | 166/245 |
| 4,305,463 | A | * | 12/1981 | Zakiewicz | 166/245 |
| 4,345,650 | A | * | 8/1982 | Wesley | 166/249 |
| 4,432,078 | A | * | 2/1984 | Silverman | 367/37 |
| 4,705,108 | A | * | 11/1987 | Little et al. | 166/248 |
| 4,783,769 | A | * | 11/1988 | Holzhausen | 367/35 |
| 4,836,284 | A | | 6/1989 | Tinker | 166/279 |
| 5,147,535 | A | | 9/1992 | Bernhardt | 210/138 |
| 5,170,378 | A | * | 12/1992 | Mellor et al. | 367/86 |
| 5,184,678 | A | * | 2/1993 | Pechkov et al. | 166/249 |
| 5,282,508 | A | * | 2/1994 | Ellingsen et al. | 166/249 |
| 5,297,631 | A | | 3/1994 | Gipson | 166/299 |
| 5,396,955 | A | | 3/1995 | Howlett | 166/249 |
| 5,460,223 | A | * | 10/1995 | Economides | 166/249 |
| 5,492,175 | A | * | 2/1996 | El-Rabaa et al. | 166/250.01 |
| 5,641,020 | A | * | 6/1997 | Cherry et al. | 166/250.1 |

(List continued on next page.)

OTHER PUBLICATIONS

Anonymous, "Seismic Source Technologies Developed for Deep Ocean Exploration", ON&T, pp 22, May/Jun. 2001.

(List continued on next page.)

*Primary Examiner*—David Bagnell
*Assistant Examiner*—T. Shane Bomar
(74) *Attorney, Agent, or Firm*—Gary P. Katz

(57) ABSTRACT

This invention provides a method for improving oil recovery, preferably a high-viscosity oil relying on gravity drainage, by applying vibrational energy. A fracture is created at a wellbore and a fluid displacement device is inserted at or near the fracture opening. The optimum oil mobilization frequency and amplitude is determined. The fluid inside the fracture is oscillated to a prescribed range of frequency and amplitude to improve oil production. Applications for using the fracture as a delivery device for vibrational energy to enhance performance of the steam-assisted gravity drainage process, vapor-extraction gravity drainage, or cyclic steam process are provided. An application to improve recovery of heavy oil by aquifer drive or peripheral waterflood is also provided.

36 Claims, 7 Drawing Sheets

U.S. PATENT DOCUMENTS

| | | | | | |
|---|---|---|---|---|---|
| 5,855,243 | A | | 1/1999 | Bragg | 166/275 |
| 5,984,578 | A | * | 11/1999 | Hanesian et al. | 405/128.2 |
| 6,095,244 | A | * | 8/2000 | Graham et al. | 166/272.2 |
| 6,227,293 | B1 | * | 5/2001 | Huffman et al. | 166/248 |
| 6,241,019 | B1 | | 6/2001 | Davidson et al. | 166/249 |
| 6,328,102 | B1 | * | 12/2001 | Dean | 166/248 |
| 6,405,796 | B1 | * | 6/2002 | Meyer et al. | 166/249 |
| 6,405,797 | B2 | | 6/2002 | Davidson et al. | 166/249 |
| 6,431,278 | B1 | * | 8/2002 | Guinot et al. | 166/252.5 |
| 6,460,618 | B1 | | 10/2002 | Braithwaite et al. | 166/249 |
| 6,467,542 | B1 | * | 10/2002 | Kostrov et al. | 166/249 |
| 6,499,536 | B1 | * | 12/2002 | Ellingsen | 166/248 |

OTHER PUBLICATIONS

Butler, R.M. and Stephens, D.J., "The Gravity Drainage of Steam–Heated oil to Parallel Horizaontal Wells", J. Canadian Petrol. Tech., 90–96, Apr.–Jun. 1981.

Butler, R.M., "Application of SAGD, Related Processes Growing in Canada", Oil and Gas Journal, pp 74–78, May 14, 2001.

Butler, R.M., "Steam and Gas Push (SAGP)", The Petroleum Society, Paper No. 97–137, pp 1–15, Jun. 8–11, 1997.

Butler, R.M., and Mokrys, I.J., "A New Process (VAPEX) for Recovering Heavy Oil Using Hot Water and Hydrocarbon Vapor", J. Canadian Petrol. Tech, 30 (1), 97–106, (1991).

Butler, R.M., Thermal Recovery of Oil and Bitumen, GravDrain, Inc., Calgary, Canada (1997).

Holzhausen, G.R. and Gooch, R.P., "Impedance of Hydraulic Fractures: Its Measurement and Use for Estimating Fracture Closure Pressure and Dimensions", SPE/DOE 13892 for SPE/DOE Low Permeability Gas Reservoirs Symposium, Denver CO., May 19–22, (1985).

Morse, P.M., Vibration and Sound, McGraw–Hill, New York (1948).

Shaaban Ashour, A.I., "A Study of the Fracture Impedance Method", Ph.D. Thesis, University of Texas at Austin, May (1994).

Sneddon, I.N., Chapters 9 and 10 in "Fourier Transforms", McGraw–Hill, (1951).

Tang, G.Q. and Morrow, N.R., "Influence of Brine Composition and Fines Migration on Curde Oil/Brine/Rock Interactions and Oil Recovery", Journal of Petroleum Science and Engineering, vol. 24, pp 99–111 (1999).

White, J.E. Underground Sound—Application of Seismic Waves, Elsevier, Amsterdam (1983).

* cited by examiner

METHOD FOR IMPROVING OIL RECOVERY BY DELIVERING VIBRATIONAL ENERGY IN A WELL FRACTURE

CROSS REFERENCE TO RELATED APPLICATIONS

This application claims priority benefit from U.S. provisional application No. 60/295,277 filed Jun. 1, 2001.

FIELD OF THE INVENTION

This invention relates generally to the field of oil production. More specifically, this invention relates to a method for improving recovery of oil, preferably heavy oil, by accelerating gravity drainage using vibrational energy generated from a well fracture.

BACKGROUND OF THE INVENTION

Steam-Assisted Gravity Drainage (SAGD) is one of the thermal methods of recovering heavy oil or bitumen with steam, where the oil contacted by steam drains down to a horizontal producing well by gravity. In the SAGD process of recovering bitumen, two horizontal wells are drilled in parallel close to each other, near the bottom of the bitumen pay zone, preferably one above the other. (Butler, R. M., Thermal Recovery of Oil and Bitumen, GravDrain Inc., Calgary, Canada (1997)). As shown in FIG. 1, steam is injected through the upper horizontal well 6, to heat the bitumen, lowering its viscosity, and create a steam chamber 1. As the steam chamber 1 grows, the lower viscosity oil 3 generated at its ceiling 5 and side walls 7 drains downward by gravity 9, and is produced through the lower horizontal well 8. Since the steam injector and the oil producer are very close to each other, any forced injection or production of fluids to speed up oil production will cause a rapid coning, or production of steam instead. Therefore, oil production has to be left to gravity as the sole driving force. While the oil recovery efficiency for SAGD is known to be fairly good, its major drawback is the slowness of oil production, because it relies solely on gravity to produce oil.

In the vapor extraction process (VAPEX), a solvent is used instead of steam to reduce the bitumen viscosity, but the oil production relies on gravity force alone and is slow. (Butler, R. M., and Mokrys, I. J., "A new process (VAPEX) for recovering heavy oils using hot water and hydrocarbon vapor", J. Canadian Petrol. Tech., 30 (1), 97–106 (1991)). A newer related process, steam and gas push (SAGP), uses steam plus a noncondensible gas and again relies on gravity drainage. (Butler, R. M., "The Steam and Gas Push (SAGP)," Paper 97–137 presented at the 48th Annual Technical Meeting of the Petroleum Society of CIM, Calgary, Jun. 8–11, 1997).

Seismic vibration in the range of 5–120 Hz is known to sometimes improve oil recovery from mature oil reservoirs. Laboratory coreflood and imbibition test results have shown oil recovery improvement due to vibration. Typically, a large mechanical vibrator pounds the ground surface to transmit seismic energy to the reservoir zone. However, due to the typically long distance between the surface and the pay zone, only a very small fraction of the vibrational energy reaches the pay zone. Furthermore, a large fraction of the vibration generated is wasted as a surface (Rayleigh) wave, which may also have environmentally detrimental effects.

To transmit vibrational energy more effectively, a vibration source is sometimes lowered downhole to the pay zone to generate vibration at the wellbore. Even then, only a small fraction of reservoir volume receives a significant amount of vibrational energy. This is because vibration generated from the downhole vibrator, which is essentially a point source, propagates spherically in all directions and diminishes very quickly due to spherical divergence.

In U.S. Pat. No. 2,670,801 (Sherborne) sonic waves are generated in a well to vibrate an oil-bearing formation to increase recovery, and in U.S. Pat. No. 3,002,454 (Chesnut) explosives are detonated in a horizontal well to increase vertical permeability by generating fractures. U.S. Pat. No. 5,297,631 (Gipson) discloses a method for oil formation stimulation by sudden release of high pressure gas from a gun in a well. Further, U.S. Pat. No. 5,396,955 (Howlett) discloses a method wherein permeability of a reservoir is enhanced by acoustic waves targeted at the reservoir. Accordingly, there is a need for a low-cost method of accelerating oil production in gravity drainage processes and thereby reducing the steam or solvent requirement, as well as the project duration, for better process economics.

SUMMARY OF THE INVENTION

This invention provides a method of improving oil recovery comprising the steps of (a) creating at least one fracture in the vicinity of at least one well in a hydrocarbon pay zone; (b) installing a vibration source device in at least one well; (c) generating a fluid oscillation in the fracture using the vibration source device whereby the fluid oscillation in the fracture generates vibrational energy that increases gravity drainage in the hydrocarbon pay zone; and (d) removing oil from the hydrocarbon pay zone. Preferably, this method is used with steam-assisted gravity drainage or vapor extraction gravity drainage processes, but may be applied to single-well processes, such as huff-n-puff or cyclic steam stimulation processes.

BRIEF DESCRIPTION OF THE DRAWINGS

The present invention and its advantages will be better understood by referring to the following detailed description and the attached drawings in which.

DETAILED DESCRIPTION OF THE INVENTION

Figure 1:
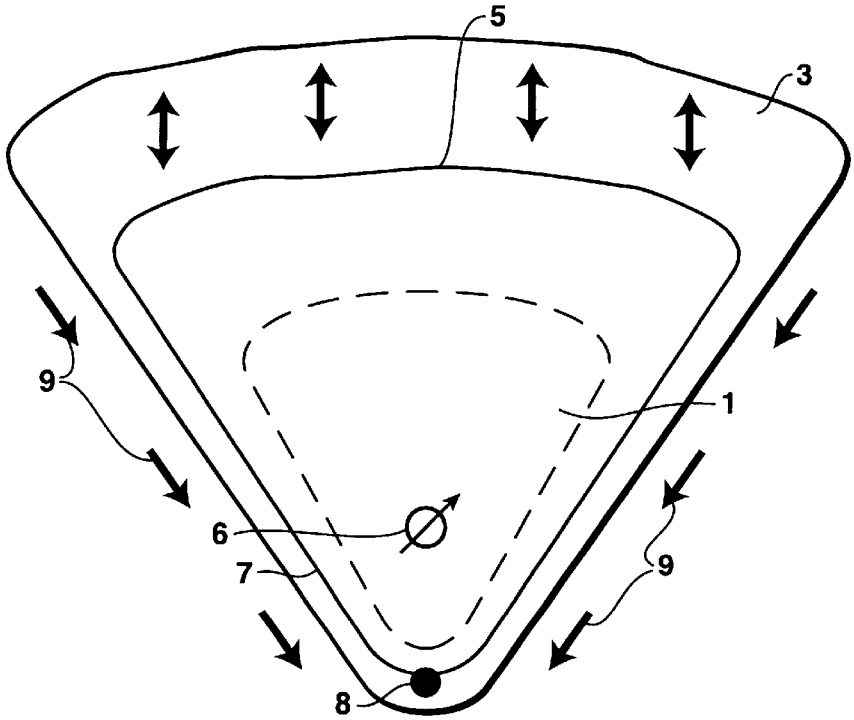
FIG. 1 is an illustration of a steam chamber generated during a steam-assisted gravity drainage process, or a solvent vapor chamber generated during a vapor extraction gravity-drainage process.

The present invention will be described in connection with its preferred embodiments. However, to the extent that the following description is specific to a particular embodiment or a particular use of the invention, this is intended to be illustrative only and is not to be construed as limiting the scope of the invention. On the contrary, it is intended to cover all alternatives, modifications, and equivalents that are included within the spirit and scope of the invention, as defined by the appended claims.

This invention provides a method to deliver vibrational energy to a large volume of reservoir efficiently, preferably utilizing a fracture generated near a wellbore as a delivery vehicle. Seismic vibration is sometimes known to improve recovery of oil that is left behind after primary or secondary recovery processes. The exact reasons why vibration mobilizes the oil by-passed during reservoir pressure depletion or water injection are not known. From our laboratory investigations and modeling efforts, which are described below, we have discovered that: (a) contrary to the earlier claims by others, vibration cannot mobilize residual oil or ganglia left after waterflood in consolidated rock; (b) vibration mobilizes only marginal amounts of oil unswept due to reservoir heterogeneity in consolidated rock; (c) vibration can enhance waterflood oil recovery from unconsolidated sands; and (d) vibration is effective in improving oil recovery when it is applied to enhance gravity drainage during heavy oil recovery from unconsolidated sands.

In the earlier claims for vibration application to improve oil recovery, the vibration generation is made at the ground surface or at the wellbore, and its delivery efficiency is invariably poor. Use of a fracture as a vibration amplifier, as described below, allows a higher efficiency of vibrational energy delivery to the reservoir zone. Accelerating gravity drainage through the application of low-frequency and/or low amplitude vibrations has not previously been proposed. Furthermore, the use of a fracture to improve vibrational energy delivery is a novel concept.

To support the above novel method of delivering vibrational energy to a large volume of reservoir, we have also developed a mechanism for enhanced gravity drainage by vibration, from laboratory experiments and modeling considerations. Unlike earlier claims to improve recovery of unswept light oil from mature reservoirs, this invention is preferably aimed at improving heavy oil recovery by gravity drainage.

Fractures of known dimensions can be generated by persons skilled in the art. However, the orientation of a fracture is determined by the magnitude of the stress vectors in the reservoir. A fracture will occur in such a manner as to relieve stress in the direction of least resistance. For example, a fracture created in a shallow oil reservoir will likely propagate horizontally because the vertical stress imposed by overburden is less than the horizontal stress. This causes the fracture to open in the direction of least stress and propagate horizontally. However, fractures deep in the formation are often vertical because the overburden stress exceeds the horizontal stress.

Figure 2:
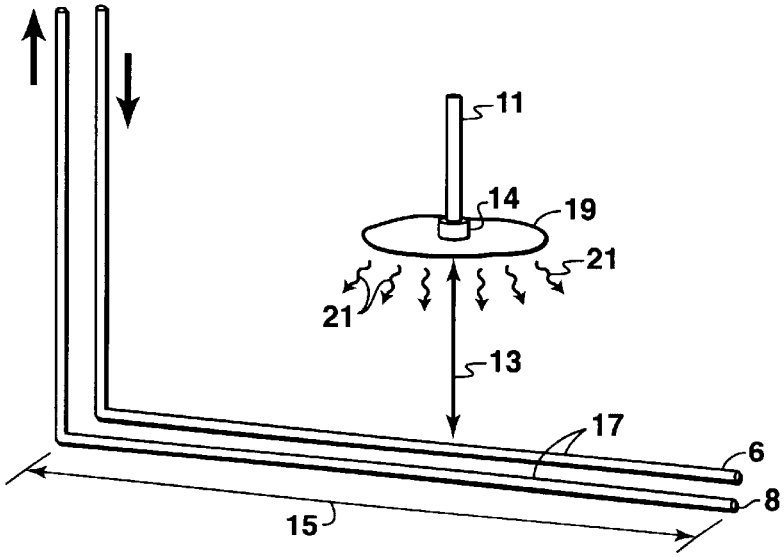
FIG. 2 is a schematic illustration of an induced fracture vibration application to steam-assisted or vapor extraction gravity drainage processes.

A preferred embodiment of this invention involves creation of at least one pancake-shaped horizontal fracture in the vicinity of the horizontal well pair in the heavy oil pay zone. The fracture can be created from a vertical well that has been drilled as a delineation well for the horizontal wells, a shut in well, an injection well, a production well, or a newly drilled well for the present purpose. The fracture would preferably be created at a certain distance above the top of pay zone. FIG. 2 illustrates a horizontal fracture 19 a distance above the center of the length 15 of the horizontal well pair 17. Depending on the reservoir condition, however, the horizontal fracture may also be created either within, or immediately below, the pay zone. If the reservoir stress conditions make it difficult to create a horizontal fracture, but instead allow creation of a vertical fracture, such a fracture could also be utilized for the purpose of vibration.

After the fracture gap is propped open with proppants, a sealant (e.g., silica flour, gel, or epoxy) may be injected into the fracture to seal the fracture wall in order to minimize fluid leakage into the formation. Furthermore, the sealant helps make the fracture an effective wave guide. Then one or more vibration source devices, which may include fluid displacement devices (i.e., commercially available modified rod-pumping units, conventional hydraulic reciprocating pumps or vibrators) or gas bubble injection devices (i.e., airguns used in offshore seismic exploration), is installed in the wellbore. Preferably, the vibration source device should be capable of generating a fluid pressure oscillation within a prescribed range of frequency and amplitude inside the fracture. Persons skilled in the art will recognize that there are many vibration source devices that can be adapted for use in this invention. The vibration source device is installed, preferably at or near the fracture. The fractures in the well are typically filled with liquid. If necessary, liquid can be added to the fracture. The vibration source device creates fluid pressure oscillation, so that the fracture gap is periodically widened and narrowed continually for a prescribed period of time.

By increasing and decreasing fluid pressure at the wellbore, fluid (e.g., water, air, gas bubble, or steam) is injected into and produced out of the fracture gap at the wellbore. Since the fracture faces have been sealed to prevent fluid leakage into the formation, the fracture gap will be widened and narrowed.

Steam or solvent can be injected into the upper injector well 6 in a well pair. As the fracture wall is periodically displaced by oscillating fluid pressure in the vertical vibration wellbore, the rock deformation wave propagates to the steam (or solvent) chamber zone, and vibrates the walls of the pores in which the interfaces between low viscosity oil and steam (or solvent) are moving. Vibration accelerates the gravity segregation between oil and steam (or solvent), making drainage of the low viscosity oil faster. Vibration also accelerates the penetration of solvent into heavy oil by dispersion/diffusion, making drainage of the reduced-viscosity oil faster. The oil collected at the chamber bottom by gravity drainage can be removed through the lower producing well 8.

In one embodiment, the inventive method allows accelerated drainage of the reduced viscosity oil, thus accelerating oil production and improving process economics. This is accomplished by preferably applying low-frequency (10

Hz–50 Hz) vibrations to the reservoir zone where a SAGD or VAPEX process is on-going. The vibration is carried out by oscillating fluid in a horizontal fracture, which is created very close to the process area and serves as a wave guide and an efficient vibration energy distributor, as shown schematically in FIG. 2. Seismic vibration has been previously applied to improve oil recovery but not to enhance gravity drainage for SAGD or other oil recovery processes that rely on gravity drainage.

This invention allows delivery of vibrational energy to a large volume of reservoir efficiently, utilizing a fracture generated near a wellbore as a delivery vehicle. Specifically, a vertical or horizontal fracture filled with liquid (typically water) is employed as a vibration chamber, into which hydraulic oscillation is emitted from the well preferably at resonance frequency (Morse, P. M., "Vibration and Sound", McGraw-Hill, New York (1948)). Since the fracture gap expands and contracts at the resonance frequency, as if it were a bellows, vibrational energy can be used very effectively and a large-amplitude deformation of reservoir rock can be achieved.

The resonance frequency can be determined through an inverse exploitation of the Hydraulic Impedance Test (HIT), which is a fairly new technology and is used to measure the length of a fracture from the wellbore. (Holzhausen, G. R., and Gooch, R. P., "Impedance of Hydraulic Fractures: Its Measurement and Use for Estimating Fracture Closure Pressure and Dimensions", SPE/DOE 13892 for SPE/DOE Low Permeability Gas Reservoirs Symposium, Denver, Colo., May 19–22, (1985)). In HIT, a sweep of acoustic frequencies are sent down the tubing from the well head to the fracture zone and the resonance frequency for the fracture is detected, from which the fracture length is deduced. Theories pertaining to the identification of resonance frequency have been developed. (Shaaban Ashour, A. I., "A Study of the Fracture Impedance Method", Ph. D. Thesis, University of Texas at Austin, May (1994)). In our invention, after the resonance frequency is determined (e.g., by using the HIT), the hydraulic oscillation is preferably generated at that frequency, using a vibration source device at the wellbore. The HIT method could be a useful tool in a system optimization process to identify preferred sets of fracture lengths and vibration frequencies.

We have discovered, through laboratory experimentation with consolidated sandstone cores, that vibration is effective only at a certain range of frequencies of approximately 30–50 Hz with respect to pressure response, oil production, and fines migration. The experiments can be characterized by the magnitude of force delivered by the laboratory vibration device to the test core. This force is periodic and is recorded as a function of time by a load cell placed between the test core and vibration device. We refer to the magnitude of this force as the "amplitude". The force amplitude can be converted to a strain or a deformation in the rock by applying Young's stress-strain relationship, and knowing the modulus of the rock and the core holder; the area of the core holder on which the force is applied; and the geometry of the rock sample. Therefore, force ($lb_f$), strain (dimensionless), and deformation ($\mu$m) are used interchangeably to describe the amplitude of the vibration being imparted to the rock. For the experiments in consolidated sandstone cores, we have discovered that amplitudes with force equivalent of at least approximately 250 $lb_f$ were necessary for improved oil mobilization and/or oil recovery with optimum results at amplitudes between 400–500 $lb_f$.

For unconsolidated sands, laboratory experiments indicated that the range of frequencies that affected oil displacement response was 10 Hz–20 Hz, with the optimum frequency estimated to be 15 Hz. Amplitudes should be sufficient to generate strains on the order of at least $5\times10^{-5}$ depending on reservoir geology and geometry. A fracture could be generated, (e.g., by hydraulic fracturing or other methods known in the art), so the resulting resonance frequency fits into the enhanced oil production frequency range. The frequency and amplitude ranges can be applied to both the present invention of generating vibrational energy utilizing fractures and conventional vibrational techniques that are known in the art.

Figure 3A:
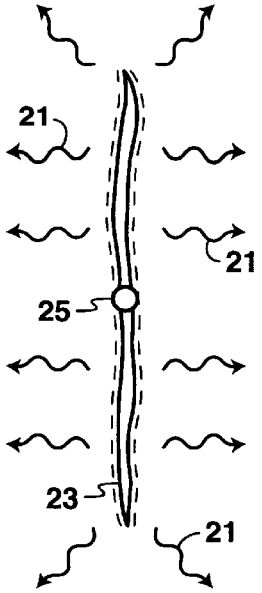
FIGS. 3(A) and 3(B) are respectively top view and side view illustrations of wave propagation from a vertical fracture.
Figure 3B:
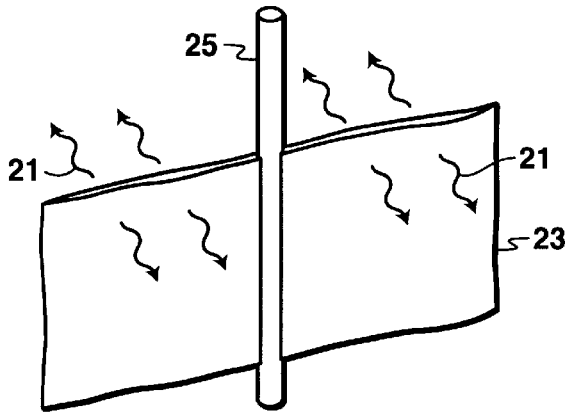

FIGS. 3(A) and 3(B) are respectively a top view and a side view that schematically illustrate propagation 21 of vibrational waves from a vertical fracture 23 from a wellbore 25. To prevent potential for unwanted channeling of injectant or production fluids, an inactive well (preferably in the middle of the reservoir zone from which enhanced oil production is desired) would be a good candidate for fracture generation and vibration operation. Since a fracture, which may be 100 to 200 feet long from the wellbore, could be generated with reasonable confidence, vibrational energy can be delivered to a large volume of the reservoir.

It is noted that the amplitude of vibration generated from a point source (V), such as those described earlier, will diminish rapidly, approximately proportional to equation 1.

$$V \approx \exp(-ar)/r \quad [1]$$

where a is the attenuation coefficient and r is the radial distance from the source. (White, J. E., "Underground Sound—Application of Seismic Waves", Elsevier, Amsterdam (1983)). On the other hand, vibration generated from a large fracture face will propagate essentially as a one dimensional (1-D) travelling wave, attenuating only due to non-elastic energy dissipation. An example of a 1-D travelling wave is a sound wave propagating in a very long tube. Neglecting wall effect and viscous dissipation, the density wave "travels uni-directionally" at the constant speed of sound. Furthermore, operation at resonance frequency allows the hydraulic energy input to be utilized at maximum efficiency.

Figure 4:
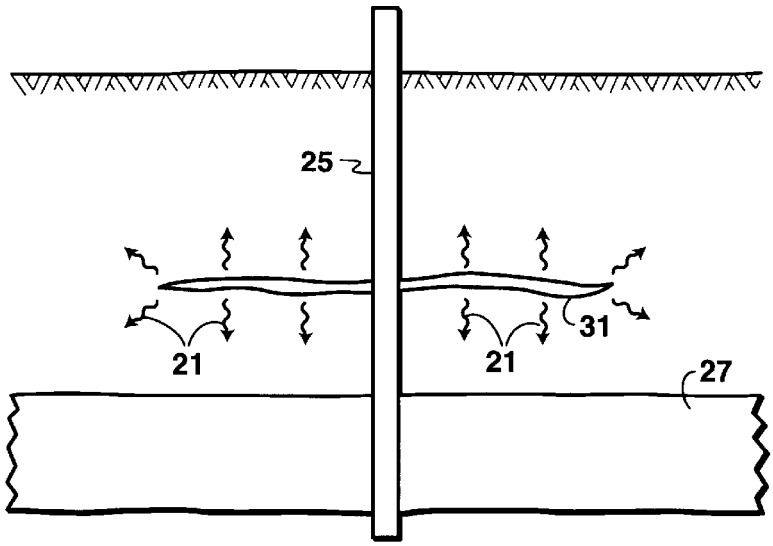
FIG. 4 is an illustration of wave propagation from a horizontal fracture.

FIG. 4 illustrates schematically propagation of a vibrational wave 21 from a horizontal fracture 31 to the pay zone 27 below. While the distance between the fracture and the pay zone will diminish the energy delivery efficiency, the large area of the horizontal fracture 31 will allow effective delivery of energy to a large volume of reservoir underneath. Due to the parallel geometry of the fracture 31 and the pay zone 27, the vibration will propagate effectively as a 1-D travelling wave with relatively minor attenuation.

In another embodiment of the invention, high pressure steam is injected through a horizontal injector to create the fracture and serve as the vibration source. This high-pressure steam would not only fracture the reservoir in the lower portion of the hydrocarbon pay zone, but also provide the driving force, in the form of steam bubble oscillations, to generate vibrations within the fluid-filled fracture. An axial nozzle array could be installed in the horizontal steam injector to focus the steam energy into the fracture created in the hydrocarbon pay zone. However, in this embodiment, the fracture may not intersect the wellbore and therefore may not be propped open or sealed, but may still be an effective means of delivering vibrational energy to the pay zone. Also, steam could be used to generate fractures and serve as the vibration source from vertical injectors drilled in the hydrocarbon pay zone as well.

While the examples given thus far include a pair of horizontal wells, the invention is not limited to well pairs nor horizontal wells. An additional embodiment of the invention involves generating a fracture in the vicinity of a single vertical well and placing a vibration source in the wellbore to oscillate fluid in the fracture, thus generating vibrations. This embodiment would apply to huff-n-puff or cyclic steam stimulation processes. In cyclic steam stimulation, steam is injected from the vertical well into the hydrocarbon formation and allowed to diffuse further into the formation, heating the oil and reducing its viscosity. The fluids, steam and low viscosity oil, are produced back through the injection well, now serving as a producing well. This process is repeated until the formation fluids are reduced to residual oil saturation.

A further embodiment of this invention permits improved volumetric sweep of heavy oil by displacing water through the application of low frequency vibrations. In producing heavy oil from a reservoir that is supported either by an aquifer drive or by peripheral water injection, the adverse mobility ratio between the high-viscosity oil and the low-viscosity water can lead to significant bypassing of oil reserves. This may cause a rapid decline in oil productivity. This is due to the formation of viscous fingers, which is accentuated by permeability variations in the reservoir. The viscous fingers lead to rapid intrusion of the aquifer water or the injected water. Therefore, oil recovery efficiency for such reservoirs is generally poor.

To improve oil recovery, small concentrations of water-soluble polymers are sometimes added to the injected water to increase viscosity. In general, polymer flooding is costly and is not economical.

Laboratory experiments suggest improved oil recovery for such adverse-mobility situations upon application of vibration. The improved sweep of oil by displacing water may be a result of vibrations improving the effective mobility ratio between oil and water, and thereby suppressing viscous fingering. These effects are accomplished by applying low-frequency, low-amplitude vibrations to the reservoir zone where the water intrusion occurs. The vibration source can be placed in an inactive injection or production well that is located at or near the water intrusion zone. Peripheral producers that are near the original water/oil contact but are now shut-in due to high water cut would be good candidates. The vibrations are distributed through the oil-bearing formation, where severe water intrusion occurs, via a fluid-filled fracture that is created downhole at the vibration source well. Fluid oscillation within the fracture is caused by a vibration source (e.g., a hydraulic pump) in the wellbore and results in cyclic widening and narrowing of the fracture gap along the length of the fracture.

Laboratory Demonstration

Figure 5:
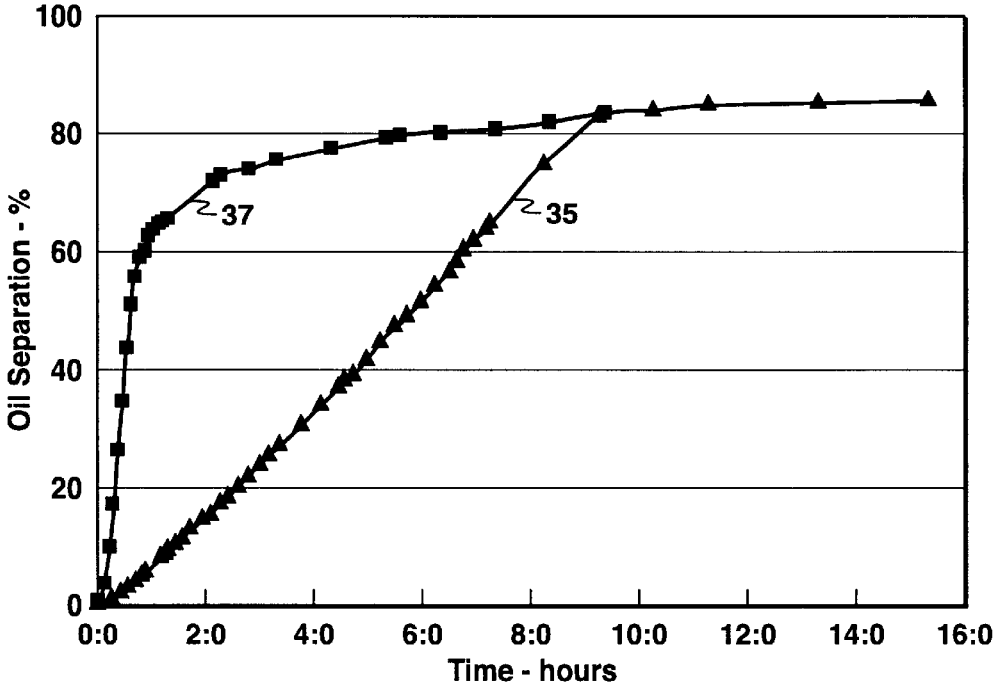
FIG. 5 is a graph of bead-pack counter-current gravity drainage experimental results.

We have discovered that low-frequency, low-amplitude vibrations can enhance gravity segregation between oil and gas in an enclosed system such as a column packed with glass beads or sands, or other unconsolidated porous media. FIG. 5 shows laboratory results from gas-oil counter-current separation tests by normal gravity drainage 35 and vibration enhanced gravity drainage 37 in a glass-bead-pack at room conditions. Oil separation rate is estimated to be accelerated by a factor of four as a result of low-frequency, low-amplitude vibrations.

Figures 6A, 6B, 6C:
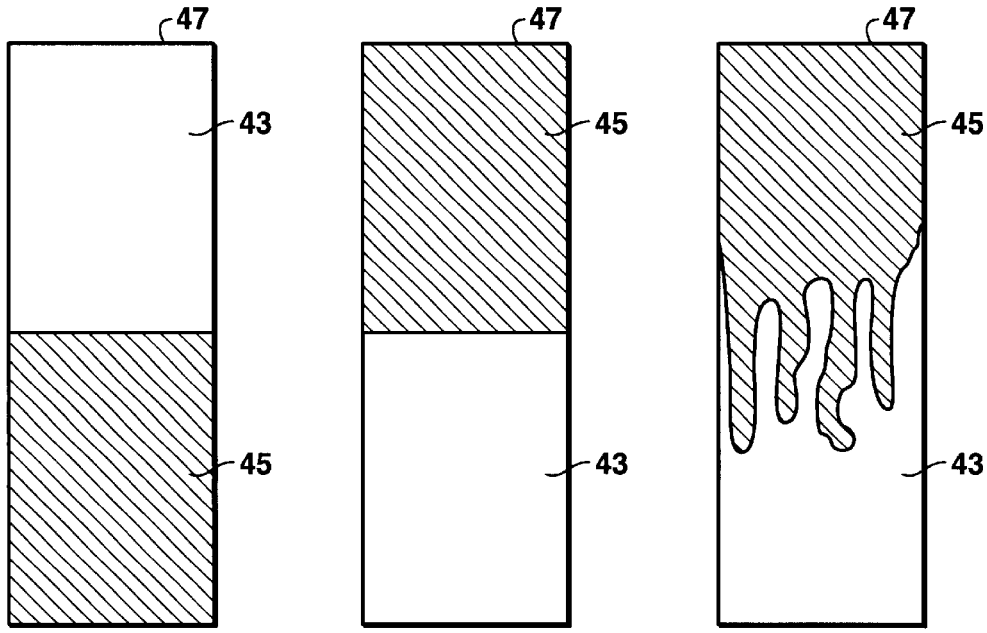
FIGS. 6(A), 6(B), and 6(C) illustrate a counter-current drainage experimental procedure.

Effects of vibration on counter-current gravity segregation between oil and gas in a sandpack have also been studied. FIGS. 6(A) through 6(C) show the procedure employed to evaluate counter-current drainage. Originally, as in FIG. 6(A), gas 43 is above the oil 45 during the preparation of the sandpack 47. The experiment is initiated by inverting the sandpack 47 so that the oil 45 is above the gas 43 as in FIG. 6(B). The gravity drainage of the oil 45 as in FIG. 6(C) is monitored over time with x-ray scanning. These experiments were conducted under reservoir stress using a metallic core holder at room conditions.

Figure 7B:
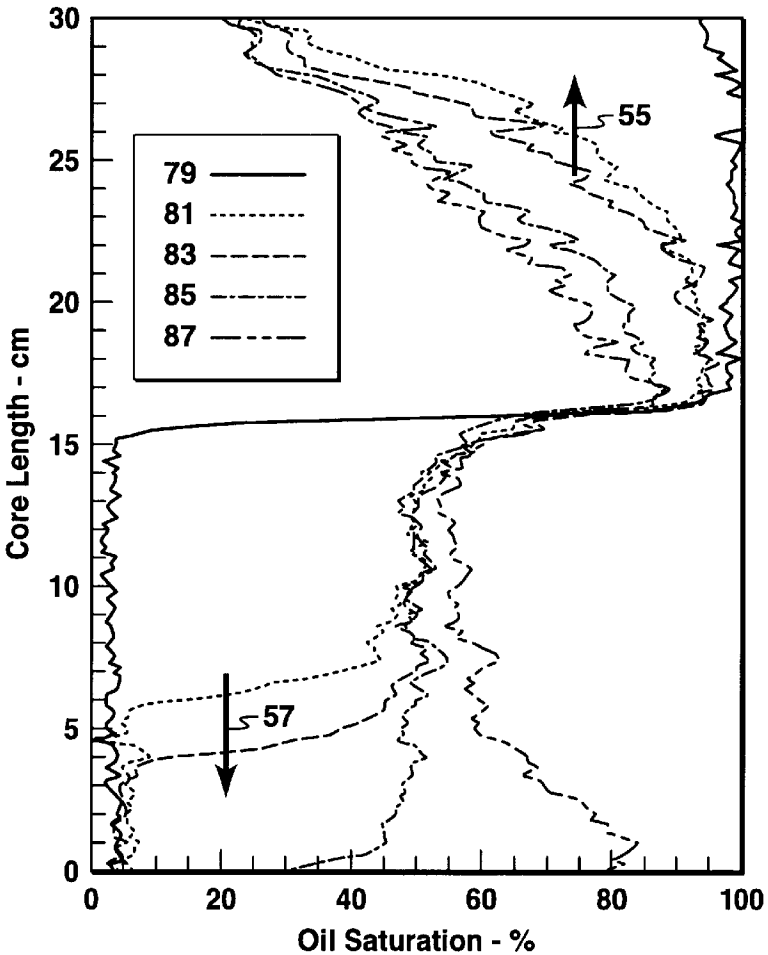
FIGS. 7(A) and 7(B) are graphs of sandpack counter-current gravity drainage experimental results.
Figure 7A:
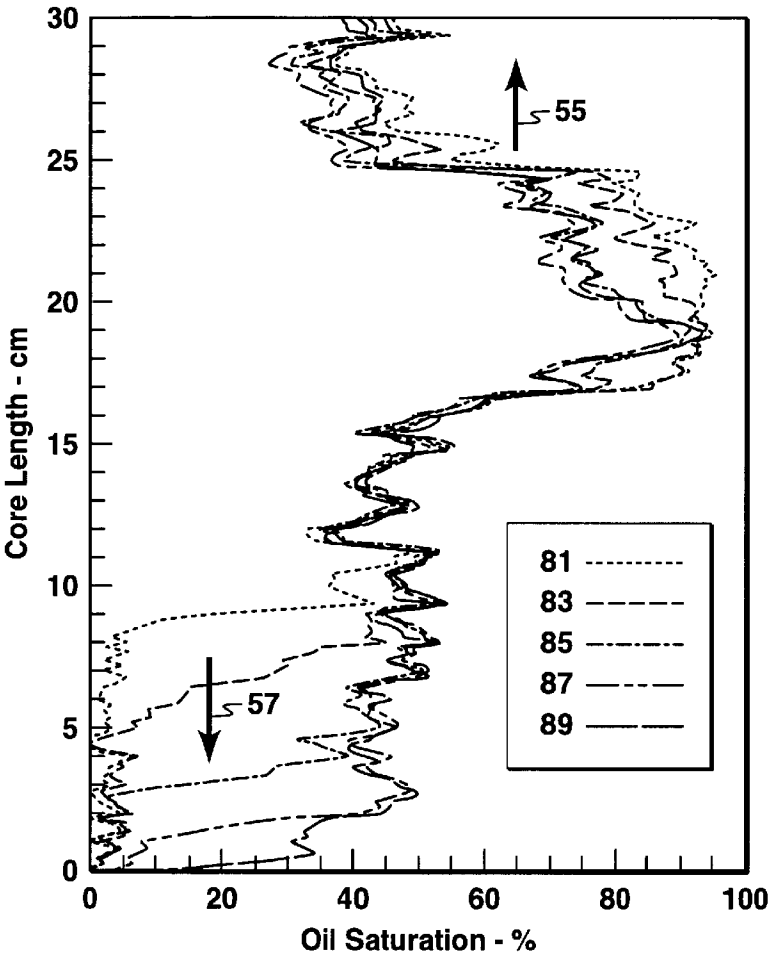

FIGS. 7(A) and 7(B) compare one-dimensional oil saturation profiles in a 12-inch long sandpack, generated from linear x-ray scans, for a base case experiment and a vibration-assisted experiment, respectively. The degassed oil has a viscosity of 132 cp and density of 0.92 g/cm$^3$ at room conditions. Continuous vibrations were applied to the sandpack at a frequency of 15 Hz and maximum amplitude of 400 $lb_f$. The overburden pressure was 500 psi. Vertical distribution of the oil saturation in the sandpack is shown as a function of time (initial: 79, day 3: 81, day 5: 83, day 10: 85, day 17: 87, and day 24: 89). The graph shows the influence of vibration on upward air invasion 55 and downward propagation 57 of oil in the sandpack. From the data analysis, the oil propagation rate was determined to be three times faster with the application of low-frequency vibrations in FIG. 7(B) than in the non-vibrated base case in FIG. 7(A), based on the time it took for oil to reach the base of the sandpack.

The exact reasons why vibration enhances gravity drainage are not known at present, but we believe that it is related to contact angle hysteresis. In contact angle hysteresis, the contact line at the oil/steam/rock juncture does not move forward unless its contact angle exceeds the "advancing" contact angle and does not retreat unless the angle becomes smaller than the "receding" contact angle. The advancing contact angle is therefore larger than the equilibrium contact angle, which in turn is larger than the receding contact angle. A contact angle is the angle formed by the fluid interface with the solid surface (i.e., pore wall).

Figure 8A:
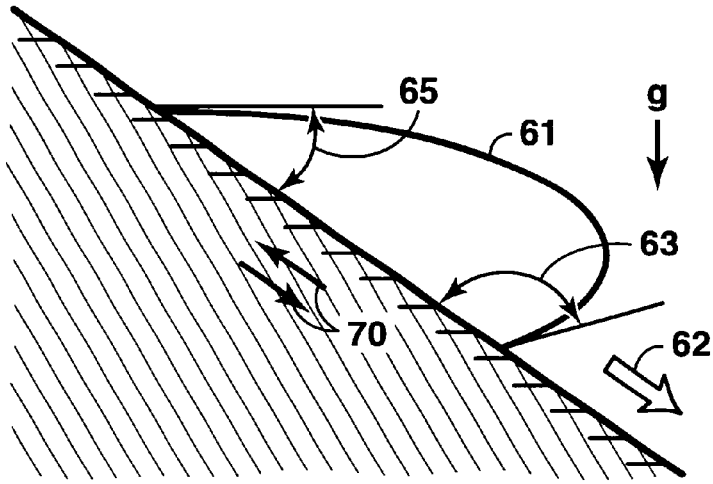
FIGS. 8(A), 8(B), and 8(C) are illustrations of contact angle hysteresis and oscillating flow patterns.
Figure 8B:
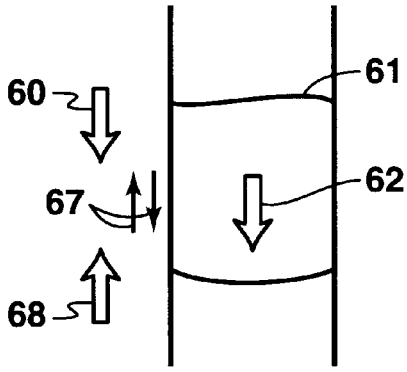
Figure 8C:
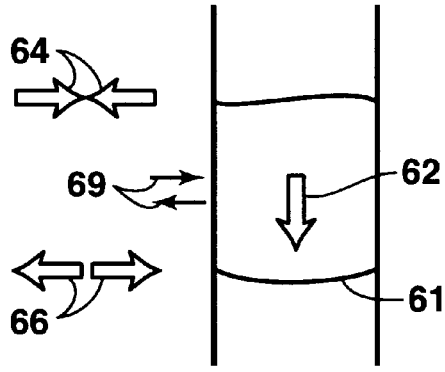

FIG. 8(A) illustrates the contact angles of an oil droplet 61 in a pore, with advancing contact angle at its front side 63 and receding contact angle at its rear side 65 and the pore wall oscillating 70 either axially 67 (Biot flow) as in FIG. 8(B) or radially 69 (squirt flow) as in FIG. 8(C). When the pore wall is moved upwards 68, the contact lines remain fixed because of contact angle hysteresis. But when the pore wall moves downward 60, the contact lines move and the downward sliding 62 of the oil droplet 61 is enhanced. The same applies to squirt flow 69: as the oil droplet 61 is squeezed 64 the front of the oil droplet moves downward 62 and when the pore wall moves out 66, the rear of the oil droplet moves downward 62. The above description equally applies when a steam bubble slowly moves up into another pore, resulting in accelerated gravity segregation of steam and oil.

Figure 9:
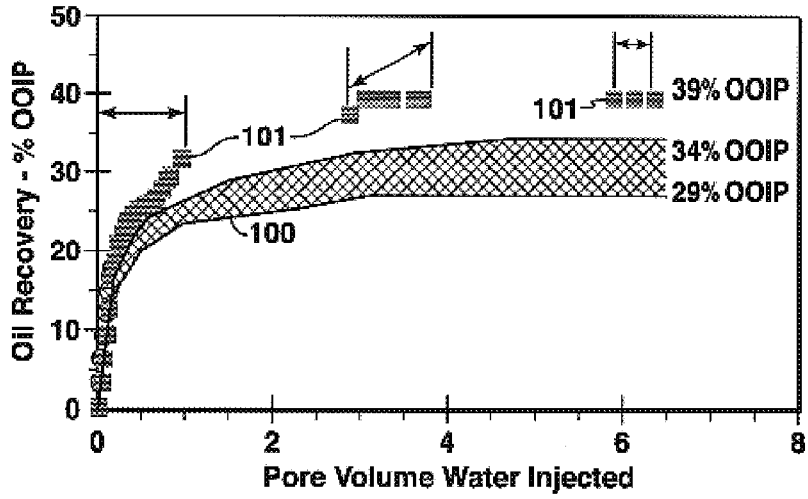
FIG. 9 is a graph of waterflood results illustrating improved oil recovery with low-frequency vibrations from unconsolidated cores.
Figure 10:
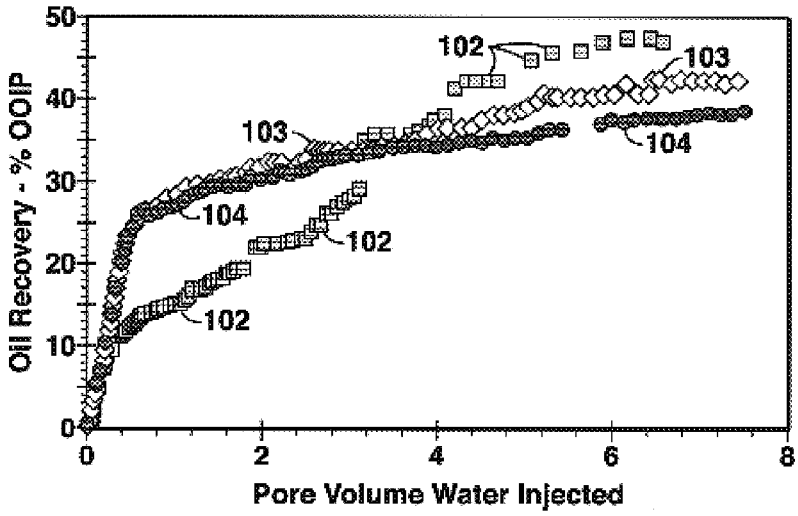
FIG. 10 is a graph of multiple vibration-assisted waterflood test results in a single unconsolidated core.

We have also discovered that low-frequency vibrations improve oil recovery during waterflooding in unconsolidated sands. Waterflood experiments performed in our lab suggest that viscous fingering may be reduced and grain compaction may occur in unconsolidated sands under low-frequency vibrations. FIG. 9 shows waterflood results that indicate oil recovery increases with the application of vibrations 101, over base case waterfloods performed without vibrations 100. Delay in water breakthrough times, observed during vibration, may indicate reduced viscous fingering and may be partly responsible for the improved oil recovery. Compaction is evident in the results shown in FIG. 10. Later water breakthrough times and lower final oil recoveries, measured during consecutive vibration-assisted waterfloods, (first vibration test 102, second vibration test 103, third vibration test 104) suggest grain rearrangement, compaction, and/or fines mobilization and trapping may be increasing with each consecutive waterflood.

Figure 11:
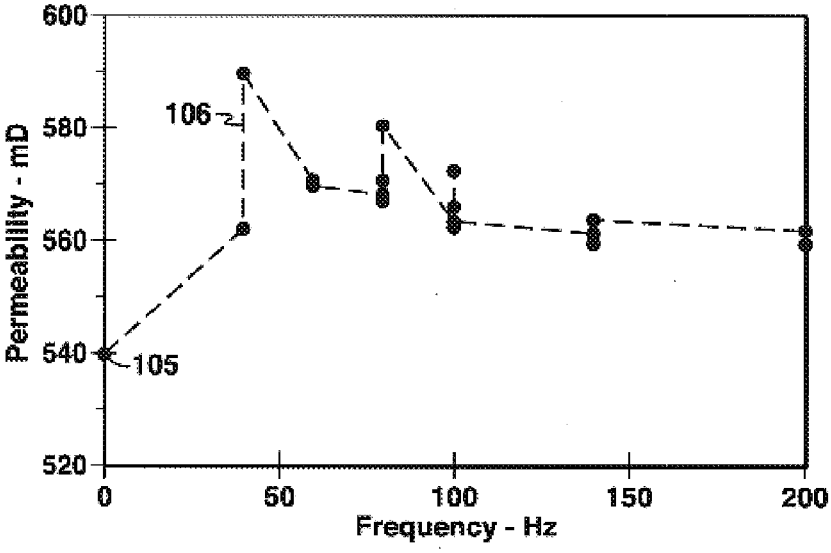
FIG. 11 is a graph illustrating the enhancement observed in permeability when vibrations were applied during single-phase flow in a consolidated core.

While the mechanism responsible for the improved waterflood recovery is not known at the present, we expect that it is related to fines mobilization and grain rearrangement. U.S. Pat. No. 5,855,243 (Bragg) provides experimental evidence that fines migrate to the interface between water and oil and form stable water/oil emulsions, subsequently decreasing the harmful effects of the adverse mobility condition during the displacement process. For our experimental data, shown in FIG. 11, significant fines production was observed at 40 Hz 106 in this consolidated sandstone. FIG. 11 illustrates an initial permeability of 540 mD 105 and increased permeability based on frequency with a flowrate of 5.0 ml/minute. A change in frequency of no more than ±2 Hz would cause fines production to cease; however, permeability enhancement was observed over a wider frequency range (5 Hz–200 Hz) and a permanent change in permeability was observed.

Modeling Assessment of the Invention Concept

Assessment of a horizontal fracture as an effective vibration delivery vehicle requires estimation of the vibration transmission efficiency in the reservoir as a function of distance from the fracture. For this purpose, the elastic wave equation that governs propagation of rock displacement in the formation needs to be solved. Assuming that the reservoir formation is a homogeneous medium and the vibration propagates in an axisymmetric manner from a circular fracture, the r- and z-components of the wave equation become $$\rho\frac{\partial^2 u}{\partial t^2} = \frac{\partial \sigma_r}{\partial r} + \frac{\partial \tau_{rz}}{\partial z} + \frac{\sigma_r - \sigma_o}{r} \quad [2]$$

$$\rho\frac{\partial^2 w}{\partial t^2} = \frac{\partial \tau_{rz}}{\partial r} + \frac{\partial \sigma_z}{\partial z} + \frac{\tau_{rz}}{r} \quad [3]$$

where u and w are rock displacements in r and z directions, and $$\sigma_r = \left[(\lambda + 2\mu)\frac{\partial}{\partial r} + \frac{\lambda}{r}\right]\mu + \lambda\frac{\partial w}{\partial z}; \quad \sigma_0 = \left[\lambda\frac{\partial}{\partial r} + \frac{\lambda + 2\mu}{r}\right]\mu + \lambda\frac{\partial w}{\partial z}; \quad [4]$$

$$\sigma_z = \lambda\left(\frac{\partial}{\partial r} + \frac{1}{r}\right)\mu + (\lambda + 2\mu)\frac{\partial w}{\partial z}; \quad \tau_{rz} = \mu\left(\frac{\partial u}{\partial z} + \frac{\partial w}{\partial r}\right); \quad [5]$$

and ρ is density of rock-fluid combination, λ is the Lame parameter, and $\mu$ is the shear modulus. The Lame parameter λ and the shear modulus $\mu$ are both constants that represent the elastic properties of the reservoir formation. Equations [2] and [3] are solved with the boundary conditions at z=0:

$$\tau_{rz}=0 \text{ for all }, \quad [6]$$

$$\sigma_z=-p(r) \text{ for } 0<r<r_b;\ u_z=0 \text{ for } r>r_b \quad [7a, b]$$

Figure 12:
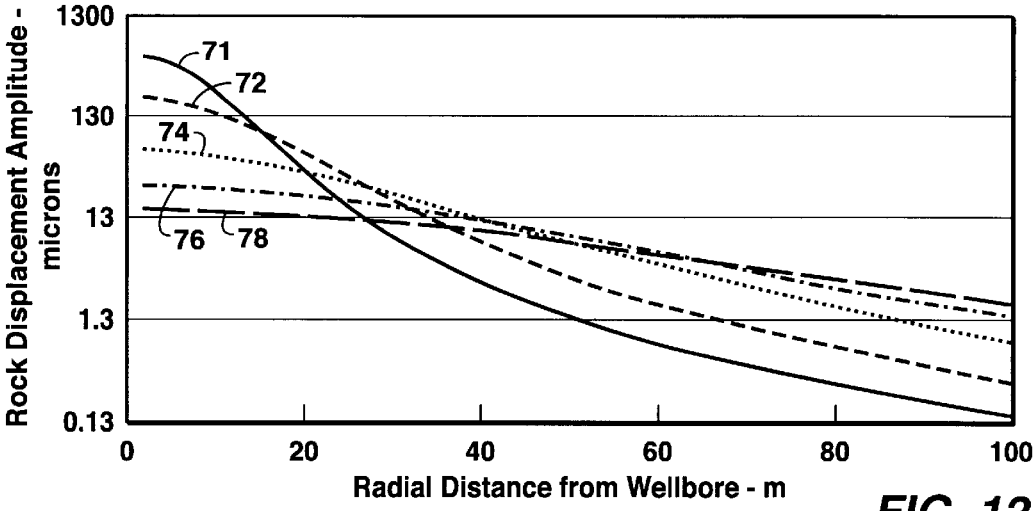
FIG. 12 is a graph of model calculations for vibration delivery efficiency of reservoir rock displacement due to vibrations.

Since the vibration to be applied is of low frequency, the solutions of the above equations at the zero-frequency limit may be employed to estimate the spatial distribution of rock displacement. (Sneddon, I. N., Chapters 9 and 10 in "Fourier Transforms", McGraw-Hill, (1951)). FIG. 12 graphically illustrates a model calculation of the rock displacement distribution, in microns ($\mu$m) at the approximate limit of zero frequency, as a function of radial and vertical distance (10 meters (shown as reference #71), 20 meters (shown as reference #72), 40 meters (shown as reference #74), 60 meters (shown as reference #76), 80 meters (shown as reference #78)) from the 10-meter radius horizontal fracture with a fluid pressure oscillation amplitude of 100 psi.

The laboratory and modeling investigations indicate that a preferred mode of the invention is application of vibration to a SAGD process for bitumen recovery from unconsolidated sands comprising a vertical vibration well 11 of FIG. 2 that is drilled above the center of a horizontal well pair 17; and a small horizontal fracture 19 is generated at a distance 13 from the upper well that is predicted to result in best vibration delivery efficiency; installing a vibration, source device 14 in the well 11 that can generate a fluid pressure oscillation within a prescribed range of frequency and amplitude inside the fracture in the wellbore, and the fracture is vibrated.

EXAMPLES

The SAGD process has been field tested at a number of places successfully, demonstrating its technical and economic viability. For the purpose of illustrating the invention, a hypothetical SAGD application is considered and the implementation of the vibration process is described.

For the SAGD operation, properties of a typical bitumen reservoir (e.g., those of Athabasca in Alberta, Canada) are employed:

Pay zone thickness=40 m;

Initial oil saturation=0.78;

Reservoir pressure=2.0 MPa;

Bitumen viscosity=100,000 cp.

Porosity=0.35;

Permeability=1.0 Darcy;

Reservoir temperature=15° C.;

In this example, it is envisioned that 500 m-long horizontal wells are drilled at the bottom portion of the reservoir, in pairs, the upper well for steam injection and the lower well for reduced-viscosity oil production. The injected steam raises reservoir temperature in the steam chamber to 188° C., which reduces the oil viscosity to 8 centipoise (cp). For a project life of 15 years, an average of 450 $m^3$/day (water equivalent) of steam is injected, and an average of 150 $m^3$/day of oil is predicted to be produced, per well pair. Details of SAGD operation are described in the monograph by Butler. (Butler, R. M., Thermal Recovery of Oil and Bitumen, GravDrain Inc., Calgary, Canada (1997)).

As shown in FIG. 2, a vertical vibration well 11 is drilled above the center of a horizontal well pair; and a 10 m-radius pancake-shaped horizontal fracture 19 is generated at the distance 13 of 100 m from the upper well and, if necessary, kept open with proppants and its walls sealed with a sealant. Depending on the length of horizontal wells and pattern spacing, additional vibration wells could be employed.

Assessment of Process Improvement by Vibration

While the performance of a conventional SAGD process could be predicted employing a thermal reservoir simulator, no simulator is yet available to account for the effects of vibration on SAGD. Therefore, we modified an analytical model developed by Butler and Stephens for SAGD performance prediction, to assess the improvement in oil production rate and cumulative oil recovery by vibration. (Butler, R. M., and Stephens, D. J., "The Gravity Drainage of Steam-Heated Oil to Parallel Horizontal Wells", J. Canadian Petrol. Tech., 90–96, April–June (1981)).

In the model, the acceleration in segregation between oil and steam by vibration is represented as an increase in "effective gravity", which varies with the vibration strength, represented by rock deformation amplitude. In this example demonstrating the field application of fracture vibration, we model the effect of the vibrations as an increase in the gravitational constant, g, to utilize the existing oil recovery prediction models. An accurate depiction of this complex interaction between rock and fluid would require a model integrating rock physics and fluid dynamics; such a model has not been sufficiently developed and tested to allow its use in predicting response to fracture vibration. Our simplified depiction of this interaction is based on the fact that delivering a force to a fluid on the pore scale, in effect, accelerates the movement of the fluid. The relationship between force and acceleration is Newton's Second Law of Motion, F=mg. If we increase the force, F, for a droplet of oil with a constant mass, m, then acceleration, g, must increase. As described in the above section, rock deformation varies with distance from the vibration source along the length of the steam chamber. Accordingly, the effective gravity is assumed to vary with distance from the vibration source.

Initially, when steam is injected into a bitumen reservoir, steam rises vertically creating a small steam chamber 1 which grows upwards until it reaches the ceiling 5 of the pay zone 7 as shown in FIG. 1. The steam chamber then expands laterally, by increasing the wedge angle formed by the two side walls. The neighboring steam chambers will then meet.

To reveal how the effective gravity affects SAGD performance, the oil production rate expression during the rising steam chamber period is shown in equation 8:

$$Q_1 = 3\left(\frac{k_o g_e \alpha}{m\,\nu_s}\right)^{\frac{2}{3}} (\phi \Delta S_o)^{\frac{1}{3}} t^{\frac{1}{3}} \quad [8]$$

where $k_o = kk_{ro}$ is the effective oil permeability; $g_e$ is effective gravity; $\alpha = \kappa/\rho c$ is thermal diffusivity; and m is an exponent defining the temperature dependence of kinematic viscosity, $$\frac{\nu_s}{\nu} = \left(\frac{T - T_r}{T_s - T_r}\right)^m,$$

$\nu$ is bitumen kinematic viscosity; $\nu_s = \nu$ at $T = T_s$; $T_r$ and $T_s$ are original bitumen temperature and steam temperature respectively; $\phi$ is porosity; $\Delta S_o = S_{oi} - S_{or}$; $S_{oi}$ is original bitumen saturation; and $S_{or}$ is residual oil saturation. Oil production rate after the steam chamber reaches the pay zone ceiling is shown in equation 9:

$$Q_2 = 2\left(\frac{k_o g_e \alpha \phi \Delta S_o H}{m\,\nu_s}\right)^{\frac{1}{2}} \left[\sqrt{\frac{3}{2}} - \sqrt{\frac{2}{3}}\, t_*^2\right] \quad [9]$$

where $$t_* = \left(\frac{k_o g_e \alpha}{\phi \Delta S_o H m\,\nu_s}\right)^{\frac{1}{2}} \left(\frac{t}{w_p}\right) \quad [10]$$

and H is height of the pay zone; and $W_p$ is half of the distance between the pattern or arrays of horizontal well pairs. The transition time (t) from the oil rate of [8] to that of [9] can be obtained by equating the two equations:

$$\left(\frac{w_p}{H}\right)^{\frac{1}{3}} t_*^{\frac{1}{3}} = \sqrt{\frac{2}{3}}\left(1 - \frac{2}{3} t_*^2\right) \quad [11]$$

Figure 13:
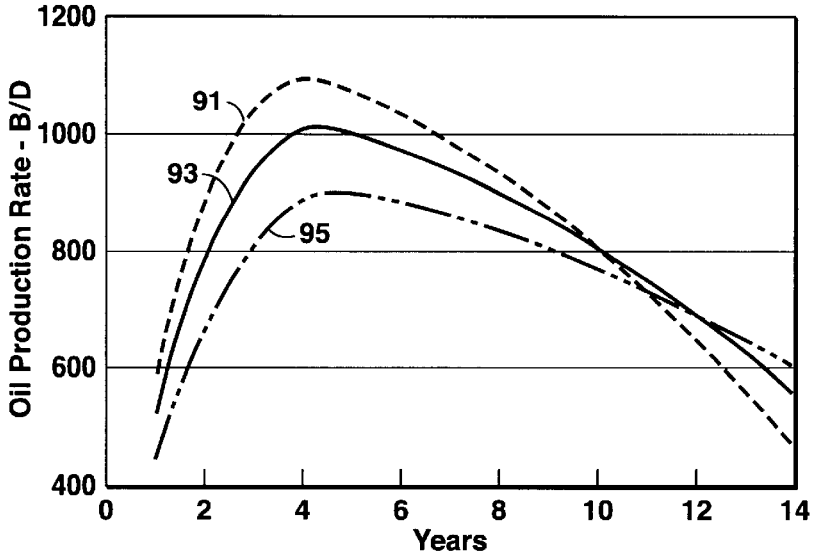
FIG. 13 is a graph of predicted oil production rates by modified analytical solution.
Figure 14:
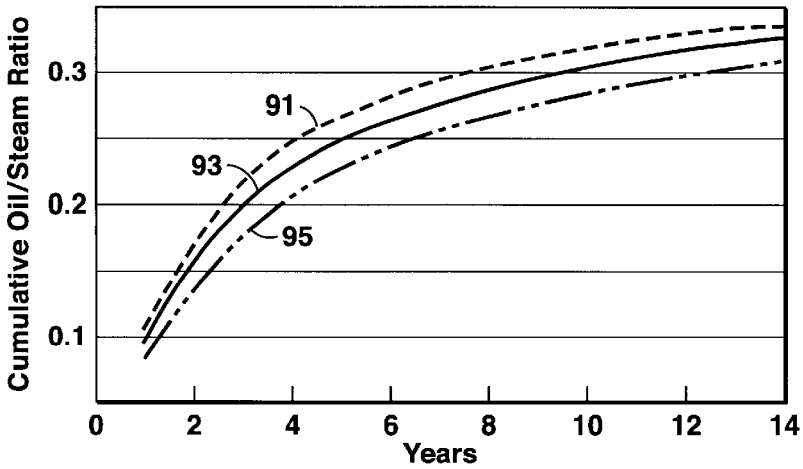
FIG. 14 is a graph of oil-steam ratio prediction by modified analytical solution.

FIG. 13 shows a sample oil production rate prediction for the process geometry, fluids, and rock properties given above. FIG. 14 shows the corresponding prediction for the oil-steam ratio as a function of "effective g" and time. FIGS. 13 and 14 demonstrate that vibration application to SAGD has potential to accelerate oil production, improve oil-steam ratio, and thereby improve the process economics. FIG. 13 illustrates oil production based on 3 g force 91, 2 g force 93 and no vibrational energy 95. Furthermore, FIG. 14 demonstrates the improved oil to steam ratio for 3 g force 91, 2 g force 93, and no vibrational energy 95.

Our preliminary economic analysis confirmed the economic benefits. This invention can therefore be utilized as a low-cost way of improving the economics of SAGD and related oil recovery processes that rely on gravity drainage, and has the advantage of not interfering with the base process design and operation.

Although the embodiments discussed above are primarily related to the beneficial effects of the inventive process when applied to SAGD and other gravity drainage processes, this should not be interpreted to limit the claimed invention, which is applicable to any situation in which vibrational energy delivered in fractures is beneficial. Criteria for using vibrational energy have been provided and those skilled in the art will recognize that many applications not specifically mentioned in the examples will be equivalent in function for the purposes of this invention.

We claim:

1. A method improving oil recovery comprising the steps of:

creating at least one fracture in the vicinity of at least one well in a hydrocarbon pay zone;

installing at least one vibration source device in at least one said well;

generating a fluid oscillation in said fracture using said vibration source device whereby said fluid oscillation in said fracture generates vibrational energy that increases gravity drainage in said hydrocarbon pay zone; and removing oil from said hydrocarbon pay zone.

2. The method of claim 1 wherein through said fluid oscillation the fracture gap is periodically widened and narrowed for a period of time.

3. The method of claim 1 wherein said fracture is created in the vicinity of a well pair.

4. The method of claim 1 wherein fracture said is propped open with proppants.

5. The method of claim 1 wherein said fracture is sealed with a sealant.

6. The method of claim 1 wherein liquid is added to said fracture.

7. The method of claim 1 wherein said fracture is within said hydrocarbon pay zone.

8. The method of claim 1 wherein said fracture is above said hydrocarbon pay zone.

9. The method of claim 1 wherein said fracture is below said hydrocarbon pay zone.

10. The method of claim 1 wherein said well in said hydrocarbon pay zone is at least one horizontal well pair and further comprising the steps of;

drilling at least one well above the center of said horizontal well pair; and creating said fracture in said well above the center of said horizontal well pair.

11. The method of claim 2 wherein the widening and narrowing of the fracture gap is controlled to produce a frequency within the range of at least approximately 1 Hz and no more than approximately 120 Hz.

12. The method of claim 2 wherein the widening and narrowing of the fracture gap is controlled to produce a strain of at least approximately $5\times10^{-5}$ with a displacement of at least approximately 5 microns.

13. The method of claim 1 wherein a hydraulic impedance test is used to determine the resonance frequency and said fluid oscillation is generated at said resonance frequency.

14. The method of claim 1 wherein said fluid oscillation is used with the steam-assisted gravity drainage process.

15. The method of claim 1 wherein said fluid oscillation is used with the vapor extraction gravity drainage process.

16. The method of claim 1 wherein said fluid oscillation is used with the steam and gas push process.

17. The method of claim 1 wherein said fluid oscillation is used with the cyclic steam stimulation process.

18. The method of claim 1 wherein the oil is removed from the hydrocarbon pay zone by aquifer drive.

19. The method of claim 1 wherein the oil is removed from the hydrocarbon pay zone by waterflooding.

20. The method of claim 1 wherein vibrations are generated to suppress the adverse-mobility condition between the high-viscosity oil and lower-viscosity water.

21. The method of claim 1 wherein the frequency of said fluid oscillation is chosen to obtain favorable oil mobilization based on the rock type.

22. The method of claim 1 wherein said vibration source device is chosen from the group consisting of rod-pumping units, conventional hydraulic reciprocating pumps, vibrators, airguns, axial nozzle arrays, and any combination thereof.

23. A method of improving oil recovery comprising the steps of:

determining a favorable frequency range for oil mobilization;

using a hydraulic impedance test to determine an appropriate length of a fracture so that the resonance frequency of a hydraulic oscillation device within said fracture is within said favorable oil mobilization range;

creating at least one fracture of said appropriate length determined by said hydraulic impedance test in the vicinity of at least one well in a hydrocarbon pay zone;

installing at least one vibration source device to generate fluid oscillation in said well;

generating a fluid oscillation in said fracture using said vibration source device; and removing oil from said hydrocarbon pay zone.

24. The method of claim 23 wherein said fracture is propped open with proppants.

25. The method of claim 23 wherein said fracture is sealed with sealants.

26. The method of claim 23 wherein liquid is added to said fracture.

27. The method of claim 23 wherein said fluid oscillation is used with the steam-assisted gravity drainage process.

28. The method of claim 23 wherein said fluid oscillation is used with the vapor extraction gravity drainage process.

29. The method of claim 23 wherein said fluid oscillation is used with the steam and gas push process.

30. The method of claim 23 wherein said fluid oscillation is used with the cyclic steam stimulation process.

31. The method of claim 23 wherein the oil is removed from the hydrocarbon pay zone by aquifer drive.

32. The method of claim 23 wherein the oil is removed from the hydrocarbon pay zone by waterflooding.

33. The method of claim 23 wherein vibrations are generated in order to suppress the adverse-mobility condition between the high-viscosity oil and lower-viscosity water.

34. The method of claim 23 wherein said fluid oscillation is generated within said favorable frequency range.

35. The method of claim 23 wherein said vibration source device is chosen from the group consisting of rod-pumping units, conventional hydraulic reciprocating pumps, vibrators, airguns, axial nozzle arrays, and any combination thereof.

36. The method of claim 23 wherein said fluid oscillation is generated at resonance frequency of said fracture.

* * * * *